US010092464B2

(12) United States Patent
Ehrstedt et al.

(10) Patent No.: US 10,092,464 B2
(45) Date of Patent: Oct. 9, 2018

(54) MEDICAL DEVICE STABILIZATION STRAP

(71) Applicant: Physio-Control, Inc., Redmond, WA (US)

(72) Inventors: Marcus Ehrstedt, Lund (SE); Bjarne Madsen Hardig, Lund (SE); Anders Nilsson, Åkarp (SE); Sara Katarina Lindroth, Lund (SE)

(73) Assignee: PHYSIO-CONTROL, INC., Redmond, WA (US)

( * ) Notice: Subject to any disclaimer, the term of this patent is extended or adjusted under 35 U.S.C. 154(b) by 173 days.

(21) Appl. No.: 14/595,068

(22) Filed: Jan. 12, 2015

(65) Prior Publication Data

US 2016/0095765 A1 Apr. 7, 2016

Related U.S. Application Data

(60) Provisional application No. 62/059,802, filed on Oct. 3, 2014.

(51) Int. Cl.
*A61G 1/044* (2006.01)
*A61H 31/00* (2006.01)

(52) U.S. Cl.
CPC ..... *A61G 1/044* (2013.01); *A61H 31/006* (2013.01); *A61H 31/008* (2013.01); (Continued)

(58) Field of Classification Search
CPC ..... A61G 1/044; A61G 1/01; A61G 7/0504; A61G 2210/30; A61H 31/00; (Continued)

(56) References Cited

U.S. PATENT DOCUMENTS 1,193,476 A 8/1916 Block
2,067,268 A 1/1937 Hans
(Continued)

FOREIGN PATENT DOCUMENTS

EP 0509773 A1 10/1992
EP 0623334 A1 11/1994
(Continued)

OTHER PUBLICATIONS

Physio-Control, LUCAS Brochure, May 2012, p. 11.*
(Continued)

*Primary Examiner* — Keri J Nelson
*Assistant Examiner* — Adam Baker
(74) *Attorney, Agent, or Firm* — Miller Nash Graham & Dunn LLP; Carla Quisenberry

(57) ABSTRACT

Techniques and devices for securing a medical device to a patient-carrying device, such as a mechanical CPR device to a stretcher, are described herein. In one aspect, a medical device stabilization strap may include a first removable attachment shackle connected to a first end of a first strap. An adjustable quick release buckle may be disposed between a second end of the first strap and a proximal end of a second strap. A second removable attachment shackle may be connected to a distal end of the second strap. The first and second removable attachment shackles may each include a U-shaped bracket for removably engaging a medical device. The adjustable quick release buckle may adjust a length of the second strap, for example, to secure the medical device to the patient-carrying device.

7 Claims, 13 Drawing Sheets

(52) U.S. Cl.
CPC .. *A61H 2031/001* (2013.01); *A61H 2201/018* (2013.01); *A61H 2201/0192* (2013.01); *A61H 2201/123* (2013.01); *A61H 2201/1246* (2013.01); *A61H 2201/1619* (2013.01); *A61H 2201/1623* (2013.01); *A61H 2201/5061* (2013.01); *A61H 2201/5064* (2013.01)

(58) Field of Classification Search
CPC .... A61H 2201/0192; A61H 2201/0142; A61H 2201/1621; A61H 31/006; A61H 31/007; A61F 5/3776; A44B 11/2557; A44B 11/28; A44B 11/006
USPC ..... 128/869, 870, 875, 876
See application file for complete search history.

(56) References Cited

U.S. PATENT DOCUMENTS 2,071,215 A 2/1937 Petersen
2,195,744 A 4/1940 Emerson
3,364,924 A 1/1968 Barkalow
3,374,783 A 3/1968 Hurvitz
3,425,409 A 2/1969 Isaacson et al.
3,509,899 A 5/1970 Hewson
3,644,943 A 2/1972 Parodi fu Leonardo et al.
3,739,771 A 6/1973 Gaquer
3,782,371 A 1/1974 Derouineau
3,985,126 A 10/1976 Barkalow
4,059,099 A 11/1977 Davis
4,060,079 A * 11/1977 Reinhold, Jr. ..... A61G 1/013 128/204.18
4,098,597 A 7/1978 Nebelung
4,198,963 A 4/1980 Barkalow et al.
4,273,114 A 6/1981 Barkalow et al.
4,326,507 A 4/1982 Barkalow
4,338,924 A 7/1982 Bloom
4,349,015 A 9/1982 Alferness
4,361,140 A 11/1982 Barkalow
4,397,306 A 8/1983 Weisfeldt et al.
4,424,806 A 1/1984 Newman et al.
4,519,106 A * 5/1985 Sandquist ..... A61F 5/05883 128/876
4,570,615 A 2/1986 Barkalow
4,610,254 A 9/1986 Morgan et al.
4,770,164 A 9/1988 Lech et al.
4,819,627 A 4/1989 Connors
4,895,173 A * 1/1990 Brault ..... A61G 1/044 128/870
4,915,095 A * 4/1990 Chun ..... A61H 31/007 601/43
4,928,674 A 5/1990 Halperin et al.
5,003,982 A 4/1991 Halperin
5,014,374 A 5/1991 Williams
5,056,505 A 10/1991 Warwick et al.
5,098,369 A 3/1992 Heilman et al.
5,176,135 A 1/1993 Fain et al.
5,184,606 A 2/1993 Csorba
5,217,010 A 6/1993 Tsitlik et al.
5,222,478 A 6/1993 Scarberry et al.
5,243,975 A 9/1993 Alferness et al.
5,257,619 A 11/1993 Everete
5,287,846 A 2/1994 Capjon et al.
5,295,481 A 3/1994 Geeham
5,327,887 A 7/1994 Nowakowski
5,330,526 A 7/1994 Fincke et al.
5,399,148 A 3/1995 Waide et al.
5,405,362 A 4/1995 Kramer et al.
5,454,779 A 10/1995 Lurie et al.
5,474,533 A 12/1995 Ward et al.
5,487,722 A 1/1996 Weaver, II et al.
5,490,820 A 2/1996 Schock et al.
5,520,683 A 5/1996 Subramaniam et al.
5,549,659 A 8/1996 Johansen et al.
5,557,049 A 9/1996 Ratner
5,564,416 A 10/1996 Jones
5,630,789 A 5/1997 Schock et al.
5,634,222 A 6/1997 Zwickey
5,634,886 A 6/1997 Bennett
5,645,522 A 7/1997 Lurie et al.
5,657,751 A 8/1997 Karr, Jr.
5,664,563 A 9/1997 Schroeder et al.
5,669,671 A * 9/1997 Laco ..... A47C 9/002 297/468
5,716,380 A 2/1998 Yerkovich et al.
5,738,637 A 4/1998 Kelly et al.
5,743,864 A 4/1998 Baldwin, II
5,755,275 A 5/1998 Rose et al.
5,769,800 A 6/1998 Gelfand et al.
5,772,613 A 6/1998 Gelfand et al.
D399,000 S 9/1998 Rothman et al.
5,806,512 A 9/1998 Abramov et al.
5,833,711 A 11/1998 Schneider, Sr.
5,891,062 A 4/1999 Schock et al.
5,913,837 A 6/1999 Smith
5,997,488 A 12/1999 Gelfand et al.
6,021,349 A 2/2000 Arend et al.
6,059,750 A 5/2000 Forgarty et al.
6,066,106 A 5/2000 Sherman et al.
6,090,056 A 7/2000 Bystrom et al.
6,125,299 A 9/2000 Groenke et al.
6,142,962 A 11/2000 Mollenauer et al.
6,149,670 A 11/2000 Worthen et al.
6,171,267 B1 1/2001 Baldwin, II
6,174,295 B1 1/2001 Cantrell et al.
6,179,793 B1 1/2001 Rothman et al.
6,213,960 B1 4/2001 Sherman et al.
6,234,984 B1 5/2001 Kelly et al.
6,259,949 B1 7/2001 Rosborough et al.
6,263,238 B1 7/2001 Brewer et al.
6,277,143 B1 8/2001 Klatz et al.
6,312,399 B1 11/2001 Lurie et al.
6,325,771 B1 12/2001 Kelly et al.
6,334,070 B1 12/2001 Nova et al.
6,351,671 B1 2/2002 Myklebust et al.
6,374,827 B1 4/2002 Bowden et al.
6,390,996 B1 5/2002 Halperin et al.
6,398,744 B2 6/2002 Bystrom et al.
6,398,745 B1 6/2002 Sherman et al.
6,435,188 B2 * 8/2002 Tyrrell ..... 128/870
6,447,465 B1 9/2002 Sherman et al.
6,533,739 B1 3/2003 Palmer et al.
6,568,009 B2 5/2003 Linger et al.
6,676,613 B2 * 1/2004 Cantrell ..... A61H 31/00 601/41
7,056,295 B2 6/2006 Halperin
7,308,304 B2 12/2007 Hampton et al.
7,569,021 B2 8/2009 Sebelius et al.
7,775,996 B2 8/2010 Stromsnes
7,841,996 B2 * 11/2010 Sebelius ..... A61H 31/006 601/41
8,002,720 B2 8/2011 Hansen et al.
8,092,404 B2 * 1/2012 Kelly ..... A61H 31/005 601/41
2001/0018562 A1 8/2001 Sherman et al.
2001/0011159 A1 9/2001 Cantrell et al.
2001/0025151 A1 9/2001 Kimball et al.
2001/0047140 A1 11/2001 Freeman
2002/0007132 A1 1/2002 Rothman et al.
2002/0026229 A1 2/2002 Weil et al.
2002/0032383 A1 3/2002 Weil et al.
2002/0055694 A1 5/2002 Halperin et al.
2002/0117173 A1 8/2002 Lynn et al.
2002/0128571 A1 9/2002 Brenneman
2002/0133197 A1 9/2002 Snyder et al.
2002/0177793 A1 11/2002 Sherman et al.
2002/0193848 A1 12/2002 Lyster et al.
2003/0055477 A1 3/2003 Dupelle et al.
2003/0066535 A1 * 4/2003 Chapman ..... A61F 5/3776 128/869
2003/0088276 A1 5/2003 Covey et al.
2003/0149462 A1 8/2003 White et al.
2003/0233129 A1 12/2003 Matos
2004/0082888 A1 4/2004 Palazzolo et al.

(56) References Cited

U.S. PATENT DOCUMENTS

| | | | |
|---|---|---|---|
| 2004/0158303 | A1 | 8/2004 | Lennox et al. |
| 2004/0162510 | A1 | 8/2004 | Jayne et al. |
| 2005/0038475 | A1 | 2/2005 | Nova et al. |
| 2009/0260637 | A1 | 10/2009 | Sebelius et al. |
| 2011/0308534 | A1 | 12/2011 | Sebelius et al. |

FOREIGN PATENT DOCUMENTS

| | | | |
|---|---|---|---|
| FR | 1476518 | A | 4/1967 |
| FR | 2382889 | A1 | 10/1978 |
| GB | 1187274 | A | 4/1970 |
| WO | WO 1996/028128 | A1 | 9/1996 |
| WO | WO 1996/028129 | A1 | 9/1996 |
| WO | WO 1999/036028 | A1 | 7/1999 |
| WO | WO 2000/027336 | A1 | 5/2000 |
| WO | WO 2000/027464 | A2 | 5/2000 |

OTHER PUBLICATIONS

International Patent Application No. PCT/SE2004/001596; Search Report; dated Mar. 1, 2005; 2 pages.

Tsuji et al.; "Development of a Cardiopulmonary Resuscitation Vest Equipped with a Defibrillator"; Proceedings of the 20th Annual Int'l Conf. of the IEEE Engineering in Medicine and Biology Society; vol. 20 No. 1; 1998; p. 426-427.

Cohen et. al; "Active Compression-Decompression, A New Method of Cardiopulmonary Resuscitation"; Journal of the American Medical Association; vol. 267 No. 21; Jun. 1992; p. 2916-2923.

Steen et al.; "The Critical Importance of Minimal Delay Between Chest Compressions and Subsequent Defibrillation: A Haemodynamic Explanation"; Resuscitation; vol. 58 Issue 3; Sep. 2003; p. 249-258.

Chamberlain et al.; "Time for Change?"; Resuscitation; vol. 58 Issue 3; 2003; p. 237-247.

* cited by examiner

300

MEDICAL DEVICE STABILIZATION STRAP

CROSS-REFERENCE TO RELATED APPLICATIONS

This application claims benefit under 35 U.S.C. § 119(e) of Provisional U.S. Patent Application No. 62/059,802, filed Oct. 3, 2014, the contents of which are incorporated herein by reference in its entirety.

BACKGROUND

Cardiopulmonary resuscitation (CPR) is a medical procedure performed on patients to maintain some level of circulatory and respiratory functions when patients otherwise have limited or no circulatory and respiratory functions. CPR is generally not a procedure that restarts circulatory and respiratory functions, but can be effective to preserve enough circulatory and respiratory functions for a patient to survive until the patient's own circulatory and respiratory functions are restored. CPR typically includes frequent torso compressions that usually are performed by pushing on or around the patient's sternum while the patient is lying on the patient's back. For example, torso compressions can be performed as at a rate of about 100 compressions per minute and at a depth of about 5 cm per compression for an adult patient. The frequency and depth of compressions can vary based on a number of factors, such as valid CPR guidelines.

Mechanical CPR has several advantages over manual CPR. A person performing CPR, such as a medical first-responder, must exert considerable physical effort to maintain proper compression timing and depth. Over time, fatigue can set in and compressions can become less consistent and less effective. The person performing CPR must also divert mental attention to performing manual CPR properly and may not be able to focus on other tasks that could help the patient. For example, a person performing CPR at a rate of 100 compressions per minute would likely not be able to simultaneously prepare a defibrillator for use to attempt to restart the patient's heart. Mechanical compression devices can be used with CPR to perform compressions that would otherwise be done manually. Mechanical compression devices can provide advantages such as providing constant, proper compressions for sustained lengths of time without fatiguing, freeing medical personnel to perform other tasks besides CPR compressions, and being usable in smaller spaces than would be required by a person performing CPR compressions.

Mechanical CPR devices, and other medical devices, may provide advantages to performing medical tasks manually, for example, on patients that may be moving, for example, on a stretcher or the like.

SUMMARY

Illustrative embodiments of the present application include, without limitation, methods, structures, and systems. In one aspect, a mechanical CPR device may include a piston, for example, to drive chest compressions of a patient to perform CPR. The piston may have a suction cup attached to an end of the piston for contacting the sternum/torso of a patient. A drive component/controller may control the piston to extend the piston toward a patient's torso and retract the piston away from the patient's torso, to perform mechanical CPR. In some aspects, the mechanical CPR device may be attached to a stretcher or other surface (e.g., a spine board, catheterization laboratory (cath lab), helicopter stretcher, etc.), for example, to enable mechanical CPR to be performed on the patient, such as while the patient is being moved or transported. In some examples, mechanical CPR may be performed on a patient in a small or crowded space, for example where moving people or objects may come in contact with the mechanical CPR device, stretcher, and/or patient. In other examples, transporting a patient may require tilting, lifting, and/or moving the patient and/or carry device in various other ways to get around objects, maneuver in tight spaces, etc. In any of these scenarios, it may be necessary to stabilize the mechanical CPR device relative to the patient in order to ensure proper operation of the mechanical CPR device.

According to the techniques and devices described herein, a strap or other stabilization mechanism may be provided to secure a mechanical CPR device and/or a back plate to a stretcher or other patient holding structure and/or to secure the mechanical CPR device to the patient directly. In one aspect, a medical device stabilization strap may include two attachments portions connected by an adjustable length strap. The attachment portions may include a removable shackle or the like, to removably and securely engage a portion of a medical device, which may include a mechanical CPR device. The strap may be of a sufficient length to wrap around a patient carrying device and/or the patient, for example, to secure a mechanical CPR device to the top surface or patient-carrying portion of the stretcher. The strap may, in some cases, be sufficiently wide to reduce or prevent movement and/or rotation of the mechanical CPR device relative to the stretcher and/or patient.

In some aspects, a medical device stabilization strap may include a first removable attachment shackle connected to a first end of a first strap, for example that may engage a mechanical CPR device. An adjustable quick release buckle may be disposed between a second end of the first strap and a proximal end of a second strap. A distal end of the second strap may be connected to a second removable attachment shackle, for example that may engage another side of the mechanical CPR device.

In some cases, a length of the second strap may be adjustable, for example via the adjustable quick release buckle. In some cases, at least one of the first and second removable attachment shackles may include at least one U-shaped bracket, for example, that is substantially rectangular in cross-section. In some examples, the first removable attachment shackle may be rotatably connected to the first end of the first strap about a first shackle member, for example to enable tensioning of the strap about or around the mechanical CPR device. The second removable attachment shackle may be rotatably connected to a third strap, which may be connected to the second strap via a second adjustable quick release buckle. In some cases, the second removable attachment shackle may be rotatably connected to an end of the second strap. One or more of the first, second, and third straps may be made of a flexible, elastic, or semi-elastic material.

In another aspect, a medical device stabilization system may include a first removable attachment shackle, engagable about the medical device, connected to a first end of a first strap. A second removable attachment shackle, which may also be engagable about the medical device, may be connected to a first end of a second strap. The second strap may be disposed about the medical device at an angle to the first strap. A length of at least one of the first and second strap may be adjustable, for example, to generate tension between the first and second straps. In some aspects the first and second strap may be disposed about a first side of a medical device, such as a mechanical CPR device, and may secure the mechanical CPR device to a stretcher or other patient-carry device, including a spine board, cath lab, skis, and the like. A third and fourth strap, in the same configuration as the first and second straps, may be included and may be attached to another side of the mechanical CPR device in a similar manner.

In some cases, at least one of the first, second, third, or fourth strap may include an adjustable buckle capable of generating tension, for example between the mechanical CPR device and a stretcher. In some aspects, each of the first, second, third, and fourth straps may include a second end attached to a hook, for example that is attachable to at least one of a stretcher frame, a stretcher, or a ski. In some examples, at least one of the first, second, third, or fourth removable attachment shackles may be made of a flexible material. In yet some examples, at least one of the first and second, or the third and fourth, removable attachment shackles may be engagable about a medical device bracket. The medical device bracket may restrict the angle between the first and second strap or the second angle between the third and fourth strap.

In some aspects, the medical device stabilization system may further include a fifth strap having a first end connected to the medial device bracket. The system may additionally include an adjustable quick release buckle disposed between a second end of the fifth strap and a proximal end of a sixth strap. The distal end of the sixth strap may be connected to a second medical device bracket. In this way, three straps may be provided on either side of a medical device, such as a mechanical CPR device, to attach and secure the device to a stretcher.

In some aspects, one or more straps, such as described above, may be used to secure the mechanical CPR device to the patient. In one aspect, one or more straps may be placed around a portion of the patient, including the torso, shoulders, waist, etc., and removably attached to the mechanical CPR device. In some aspects, a back plate in combination with one or more straps may be used to aid in securing the patient to the mechanical CPR device, for example, about the shoulders and/or wait of the patient. In one example, a patient may be secured to a mechanical CPR device using a back plate and at least one strap, for example in a tight or otherwise small space. The patient secured to the back plate may then be secured to a stretcher or other carrying device by one or more additional straps, for example, when the patient is transported to a larger space. In this way, a mechanical CPR device may be secured to a patient to enable mechanical CPR to be performed on the patient in limited space areas where a stretcher may not be accessible and/or in situations where the patient will be transported to receive further treatment.

In another aspect, a method for securing a medical device to a patient carrying device may include first attaching one or more straps to the medical device. The one or more straps may then be positioned about the patient carrying device. The method may additionally include tensioning the one or more straps about a portion of the patient carrying device to reduce at least one of rotation or movement of the medical device relative to the patient carrying device. In some cases, tensioning the one or more straps may include adjusting a length of the one or more straps via an adjustable buckle.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure.

DETAILED DESCRIPTION OF ILLUSTRATIVE EMBODIMENTS

According to the described techniques, medical devices, such as a mechanical CPR compression device, may be secured to a patient carrying device, such as a stretcher, using one or more straps. The one or more straps may minimize or eliminate movement of the medical device relative to the stretcher, which may in turn provide more safe operation of the medical device, especially, for example, when the patient is moving or in danger of unwanted contact or jarring caused by crowds or objects.

The following description illustrates example strap and stabilization systems for a mechanical CPR device, in particular. However, it should be appreciated that the devices and techniques described herein may similarly be used in other applications. These other applications may include other mechanical devices, particularly medical devices, where proper and/or safe operation requires minimizing movement between the medical device and the patient.

Figure 1:
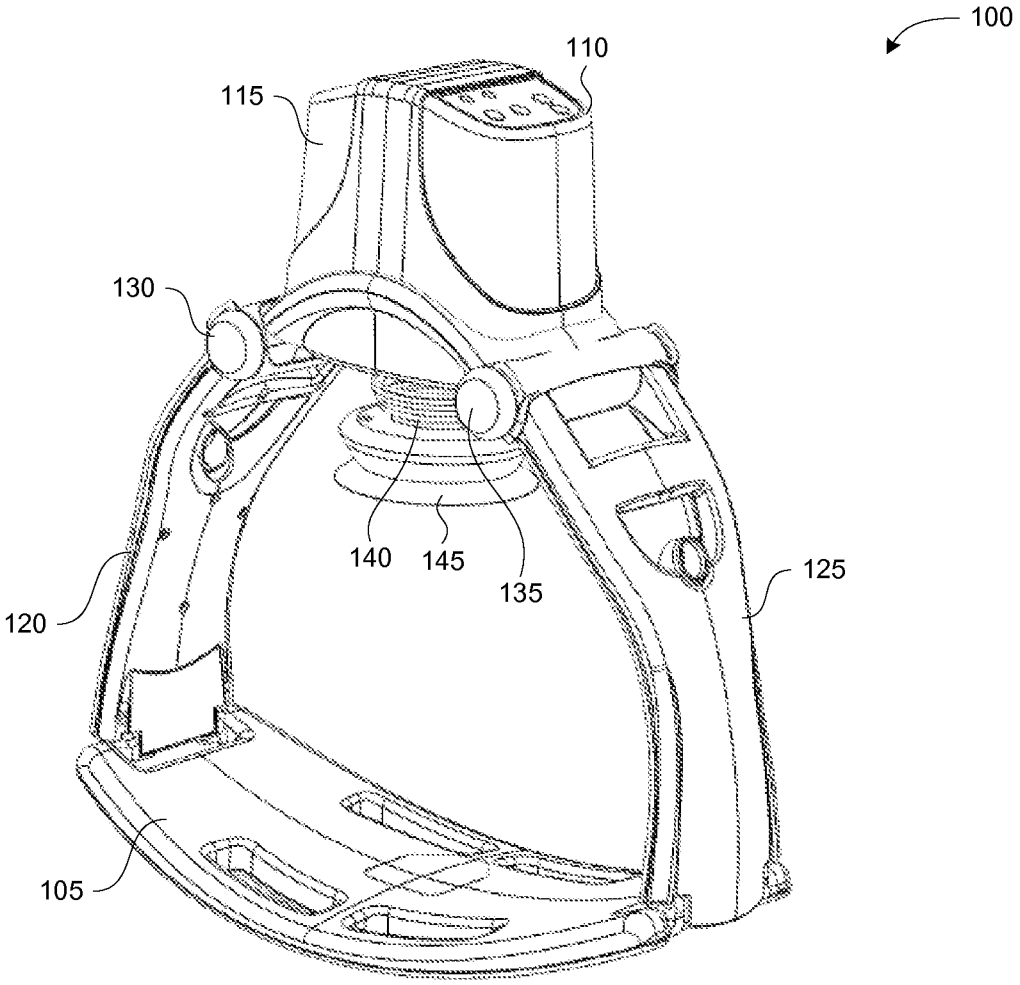
FIG. 1 depicts an isometric view of one embodiment of a mechanical CPR device.

FIG. 1 depicts an isometric view of one embodiment of a mechanical CPR device 100. The mechanical CPR device 100 includes a lower portion 105 and an upper portion 110. The upper portion 110 can have a main portion 115 and two legs 120 and 125. Each of the legs 120 and 125 can be releasably connected to one of the sides of the lower portion 105. Items that are releasably connected are easily disconnected by a user, such as connections that can snap in and snap out, connection that do not require the use of tools to disconnect, quick-release connections (e.g., push button release, quarter-turn fastener release, lever release, etc.), and the like. Items are not releasably connected if they are connected by more permanent fasteners, such as rivets, screws, bolts, and the like. In the embodiment shown in FIG. 1, the legs 120 and 125 are rotatably attached to the main portion 115 about axes 130 and 135, respectively. However, in other embodiments, the legs 120 and 125 can also be fixed with respect to the main portion 115.

The main portion 115 can include a piston 140 with an end 145. The end 145 can be blunt, contoured, or otherwise configured to interact with a patient's torso. The end 145 can also have a suction cup that can temporarily attach to a patient's torso. The main portion 115 can include other components. For example, the main portion 115 can include a drive component, such as a motor or actuator, that can extend and retract the piston 140. The main portion 115 can include a power source, such as a rechargeable battery, that can provide power for the drive component. The main portion 115 can also include a controller that can control the movement of the piston 140 by controlling the drive component. In one embodiment, the controller can include a processor and memory, and the memory stores instructions that can be executed by the processor. The instructions can include instructions for controlling the piston 140 by controlling the drive component. The main portion 115 can also include one or more sensors that can provide inputs to the controller. The one or more sensors can include one or more of a force sensor to sense a force exerted by the piston 140, a spring sensor to sense a displacement of the piston 140, a current sensor to sense an amount of current drawn by the drive component, or any other type of sensor. The main portion 115 can also include one or more user input mechanisms, such as buttons, keys, displays, and the like. A user can input information to adjust the operation of the mechanical CPR device 100, such as a depth of compressions, a frequency of compressions, a maximum exertion force by the piston 140, and the like.

Figure 2A:
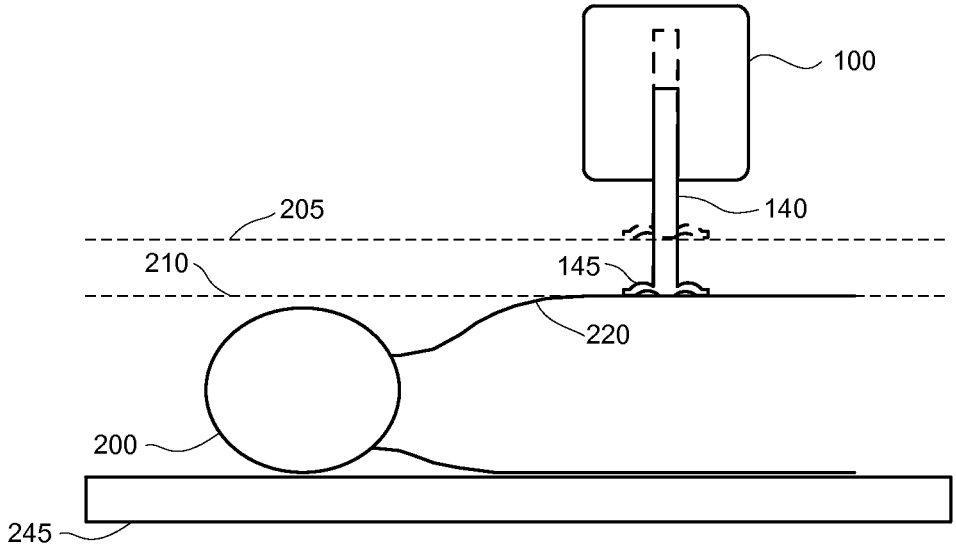
FIGS. 2A, and 2B, depict example operations of a mechanical CPR device on a patient, in accordance with the present disclosure.
Figure 2B:
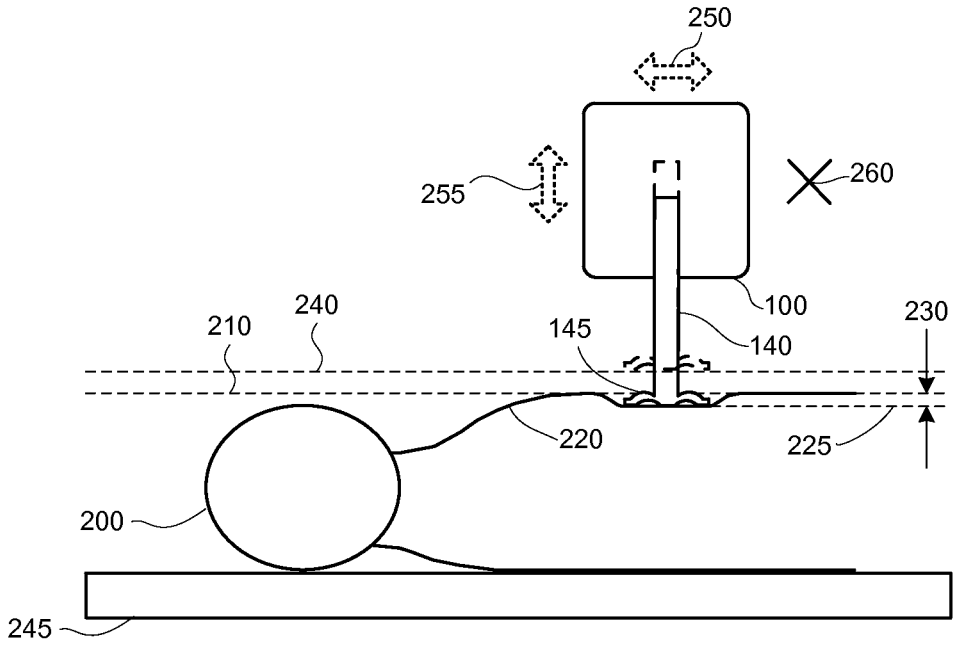

FIGS. 2A and 2B depict example operations of a mechanical CPR device 100 on a patient 200. FIGS. 2A and 2B depict a portion of a mechanical CPR device 100 that includes a piston 140. The end of the piston 140 includes a suction cup 145. The depictions in FIGS. 2A and 2B show cross sectional views of the mechanical CPR device 100, the piston 140, and the suction cup 145. The mechanical CPR device 100 could also include other components that are not depicted in FIGS. 2A and 2B, such as other components of mechanical CPR device 100 described above in reference to FIG. 1. As illustrated the patient 200 is resting or positioned on top of a stretcher or other patient-carrying device 245. In some aspects the patient-carrying device 245 may be mobile or immobile.

As depicted in FIG. 2A, the piston 140 is at first fully retracted into the mechanical CPR device 100, such that the suction cup 145 is at a position 205 above a torso 220 of patient 200. In this position, the suction cup 145 is not in contact with the patient's torso 220. From this first position 210, the piston 140 can be extended until the suction cup 145 of piston 140 is at a position or height 210. At height 210, the suction cup 145 is in contact with the patient's torso 220. The piston 140 can be extended by a drive component, such as a motor or an actuator, in the mechanical CPR device 100. A controller in the mechanical CPR device 100 may control the drive component.

From position 220, depicted in FIG. 2A, the piston 140/suction cup 145 can be further extended toward the patient's torso 220 until a threshold is reached so that air is forced out from the lower side of the suction cup 145 and the torso or chest 220 of patient 200 is compressed, such as in position 225 depicted in FIG. 2B. In one example, the threshold can be a force threshold and the controller in the mechanical CPR device 100 can measure the force exerted by the piston 140 as the air is forced out from the lower side of the suction cup 145 and the patient's chest 220 is compressed. Once the force exerted on the patient's chest 220 by the piston 140 reaches the force threshold, the controller can stop the piston 140 from being extended any further, such as at position 225. In another example, the threshold can be a distance threshold and the controller in the mechanical CPR device 100 can measure the distance travelled 230 by the piston 140 as the patient's chest 220 is compressed. Once the distance travelled 230 by the piston 140 reaches the distance threshold, the controller can stop the piston 140 from being extended any further. In yet another example, the threshold can be a pressure threshold and a pressure sensor can sense the pressure in the area between the suction cup 145 and the patient's torso 220. As the patient's chest 220 is compressed, and the pressure reaches the pressure threshold, the controller in the mechanical CPR device 100 can stop the piston 140 from being extended any further. In any of these examples, the patient's torso 220 may be compressed as the piston 140 is extended, such as in the depiction in FIG. 2B. At position 225, the suction cup 145 is attached to the patient's torso 220 and the patient's torso 220 is compressed by the piston 140.

From position 225, the piston 140 can be retracted to position 210, as depicted in FIG. 2A, where the suction cup 145 originally came into contact with the patient's torso 220. From position 210, the piston 140 can be further retracted until the position 235, where the piston 140 reaches a second threshold. The second threshold can be a force threshold, such as a force exerted when pulling up on the patient's torso 220. This second threshold can be measured by a spring activation sensor or other force sensor. For example, the piston 140 can be retracted until the spring activation sensor is activated and then the drive component can stop retracting the piston 140. From the position 235, the piston 140 can be extended toward the patient's torso 220, contacting the patient's torso at 210, compressing the patient's torso 220 by extending to position 225, and decompressing the patient's torso 220 by moving away from the patient's torso 220 to position 235. By repeating the movement of the piston 140 through positions 235, 210, 225, 210, to 235, mechanical CPR can be performed on patient 200.

In some cases, the patient 200 may be transported, for example, with the stretcher 245 and the mechanical CPR device 100. In other examples, the patient 200, stretcher 245, and/or the mechanical CPR device 100 may experience jarring or contact with other objects or people, changes in orientation (e.g., tilting), etc. In either scenario, the mechanical CPR device 100 may be moved or rotated in the horizontal plane, represented by arrows 250, in the vertical plane represented by arrows 255, or in laterally (in and out of the page), represented by "X" 260. Excessive movement, and in some cases, any movement at all, may negatively affect the performance of mechanical CPR on the patient 200. By using the described stabilization straps or systems, movement in the planes 250, 255, and 260 may be reduced or eliminated to provide potentially more effective, and safer, treatment to patient 200.

Figure 3A:
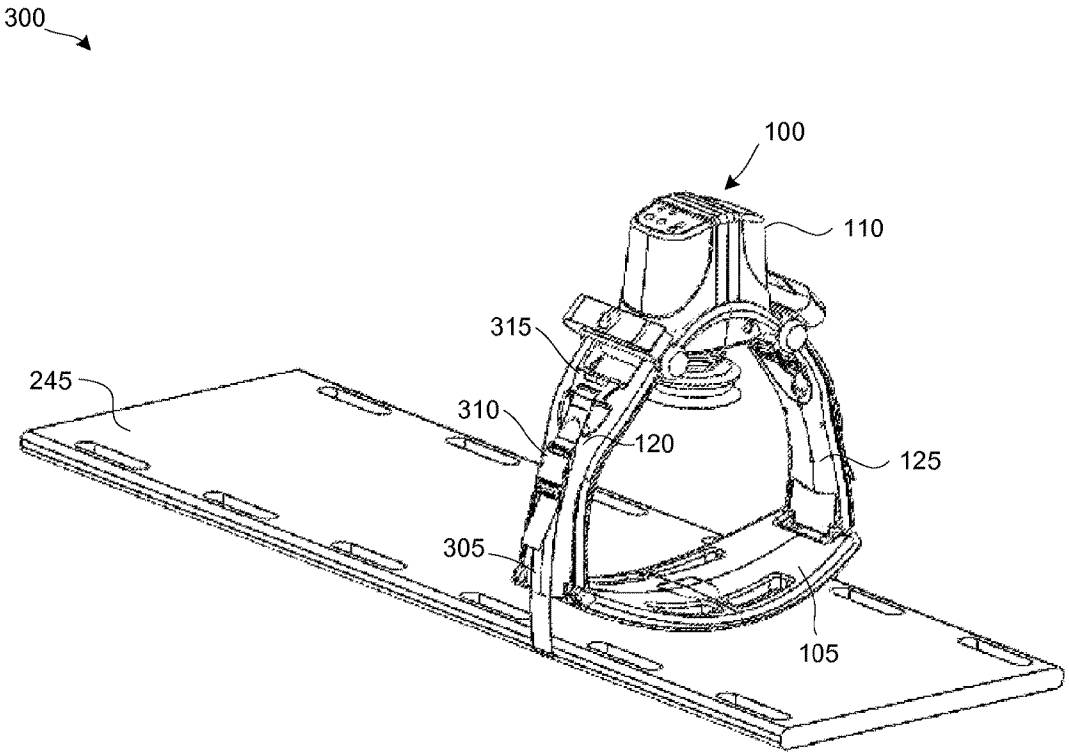
FIGS. 3A and 3B depict an example of a strap mechanism that is configured to attach a mechanical CPR device to a stretcher, in accordance with the present disclosure.
Figure 3B:
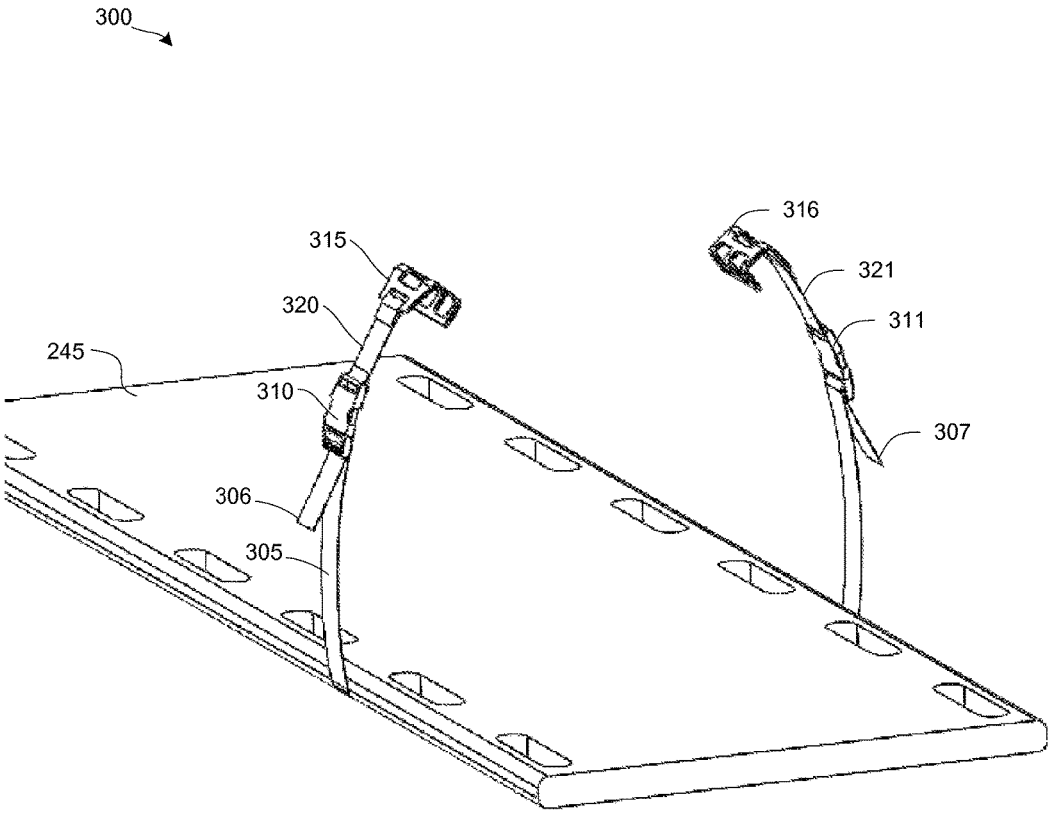

FIGS. 3A and 3B depict isometric views of an example stabilization strap/system 300. FIG. 3A depicts the stabilization strap 300 installed on a mechanical CPR device 100 and a stretcher 245, whereas FIG. 3B depicts the stabilization strap 300 in the same position, but without the mechanical CPR device 100.

In one example, the mechanical CPR device 100 may include arms 120, 125 connected to a bottom portion 105, that may rest on the top surface of a stretcher 245. The strap system 300 may be removably connected to one side 120 of the mechanical CPR device 100, for example by positioning a first removable attachment shackle 315 about an opening in one of sides 120, 125. The first removable attachment shackle 315 may be connected to a strap 305, for example with an adjustable quick release buckle 310. The opposite or distal end of the strap 305 may be connected to a second removable attachment shackle 316. The adjustable quick release buckle 310 may enable adjustment of the length of strap 305. The strap 305 may be placed around a bottom surface of the stretcher 245, aligned on the other side 125 of the mechanical CPR device 100, and removably attached to an opening in side 125 of the mechanical CPR device 100. Removably attaching the strap 305 to the other side 125 of the mechanical CPR device 100 may include aligning and placing the second removable attachment shackle 316 at least partially within an opening of side 125. Once both attachment shackles 315, 316 are in place, the adjustable quick release buckle 310 may be adjusted to create tension in the strap 305 and pull the mechanical CPR device 100 tightly toward the stretcher 245. In some cases, two adjustable quick release buckles 310 and 311 may be disposed on strap 305. Buckles 310 and 311 may allow for independent tensioning of the strap 305 on each side 120, 125 of the mechanical CPR device 100. This may result in a more stable configuration of the mechanical CPR device 100 with respect to the stretcher 245. By securing the mechanical CPR device 100 to the stretcher 245, the strap system 300 may minimize or eliminate movement of the mechanical CPR device 100 with respect to the stretcher 245 and the patient 200, for example in directions or planes 250, 255, and/or 260.

In one particular example, the stabilization strap/system 300 may include a first removable attachment shackle 315 connected to a first end of a first strap. An adjustable quick release buckle 310 may be disposed between a second end of the first strap and a proximal end 306 of a second strap 305. A second removable attachment shackle 316 may be connected to a distal end 307 of the second strap 305.

In some cases, buckles 310 and 311 may be quick release, such that one portion of strap 305 may be disconnected from another portion of strap 305. Quick release buckles 310, 311 may be particularly useful when a patient needs to be moved from the stretcher 245. In this scenario, each buckle 310, 311 may be released to enable moving the patient 200 and/or the mechanical CPR device 100 from the stretcher 245. In emergency scenarios, the ability to quickly release the strap system 300 and remove the mechanical CPR device 100 and the patient 200, or just the patient 200, may be critical.

In some aspects, straps 320 and 321 may connect the shackles 315, 316 to the quick release buckles 310, 311. The buckles 315, 316 may be rotatably connected to straps 320, 321, for example, to allow for a more precise fit around sides 120, 125 of the mechanical CPR device 100, and/or to create more tension in pulling the mechanical CPR device 100 towards the stretcher 245. Strap 305 may have two ends 306, 307 that adjustably attach to buckles 310 and 311. By pulling strap ends 306, 307, the length of the strap 305 may be shortened, for example, to pull the mechanical CPR device 100 closer to the stretcher 245. In some or all of the examples given above, one or more of straps 305, 320, and 321 may be made of a flexible and/or elastic or semi elastic material.

Figure 4A:
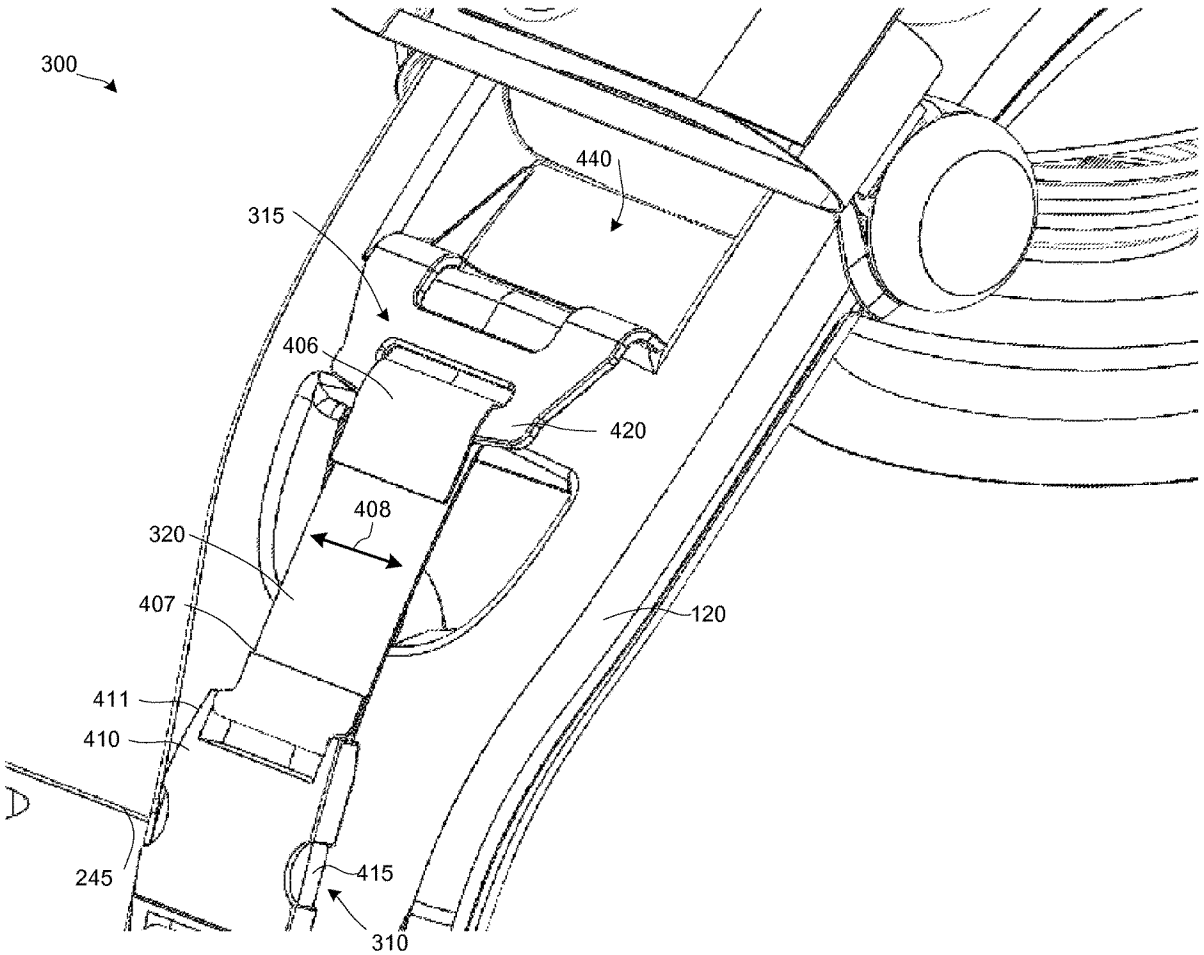
FIGS. 4A and 4B depict isometric views of a strap mechanism connected to a mechanical CPR device, in accordance with the present disclosure.
Figure 4B:
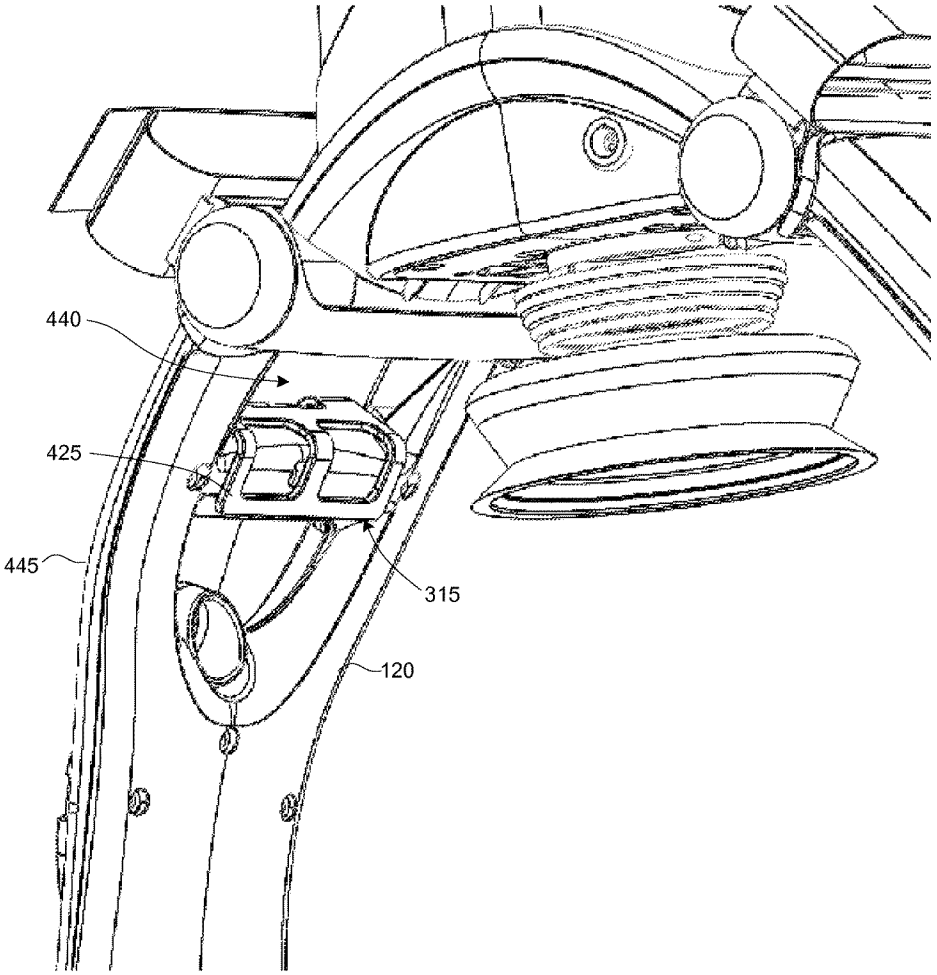

FIGS. 4A and 4B depict close-up isometric views of example stabilization strap/system 300 described above in reference to FIGS. 3A and 3B. FIG. 4A depicts the stabilization strap 300 installed on a mechanical CPR device 100 from a perspective on the outside of side 120, whereas FIG. 4B depicts the stabilization strap 300 in the same position, but from a perspective above the stretcher 245.

The shackle 315 may engage a ledge or other structure in an opening 440 located in or on side 120 of mechanical CPR device 100. The shackle 315 may include a first shackle member 420 in the shape of partially rectangular loop connected to shackle 315. A first end 406 of strap 320 may loop around the shackle member 420, thus creating a rotatable engagement between the strap 320 and the shackle 315. A second end 407 of the strap 320 may similarly rotatably engage a loop portion 411 connected to buckle 310. The buckle 310 may include a female portion 410, connected to loop 411, and a male portion 415 that fits into the female portion 411. The male portion 415 may be removed or detached from the female portion 410, for example, by compressing part of the male portion 415. This may enable quick release of strap 305 from straps 320, 321, thus enabling quick upward removal of the CPR device 100 from the stretcher 245. In some aspects, strap 320, and strap 321 on the other side 125 (not shown), may have a width 408. In some cases, strap 305 may also have the same or similar width 408. The width 408 may be designed to reduce or eliminate rotational movement (e.g., movement in at least one of planes 250, 255, or 260) of the mechanical CPR device 100.

As depicted in FIG. 4B, the opening 440 on side 120 may be substantially rectangular in shape (side 125 may contain a similar opening), with the side 120 having a thickness 445. In some cases, the shackles 315, 316 may each include a U-shaped, V-shaped, C-shaped, or other similar-shaped bracket portion 425. In some cases, the U-shaped bracket portion may have a substantially rectangular cross-section. The U-shaped bracket portion 425 may have an internal dimension that is slightly greater than the thickness 445 of side 120. In this way, the U-shaped bracket portion 425 of shackles 315, 316 may easily and securely slide over and engage the opening 440 of side 120, and a similar opening in side 125 (not shown). Tightening strap 305, may, as a result, exert a downward force on each side 120, 125 of the mechanical CPR device 100, pulling it tightly against the stretcher 245. In this way, movement 250, 255, and/or 260 may be reduced or eliminated to enable safer operation of the mechanical CPR device 100.

Figure 5A:
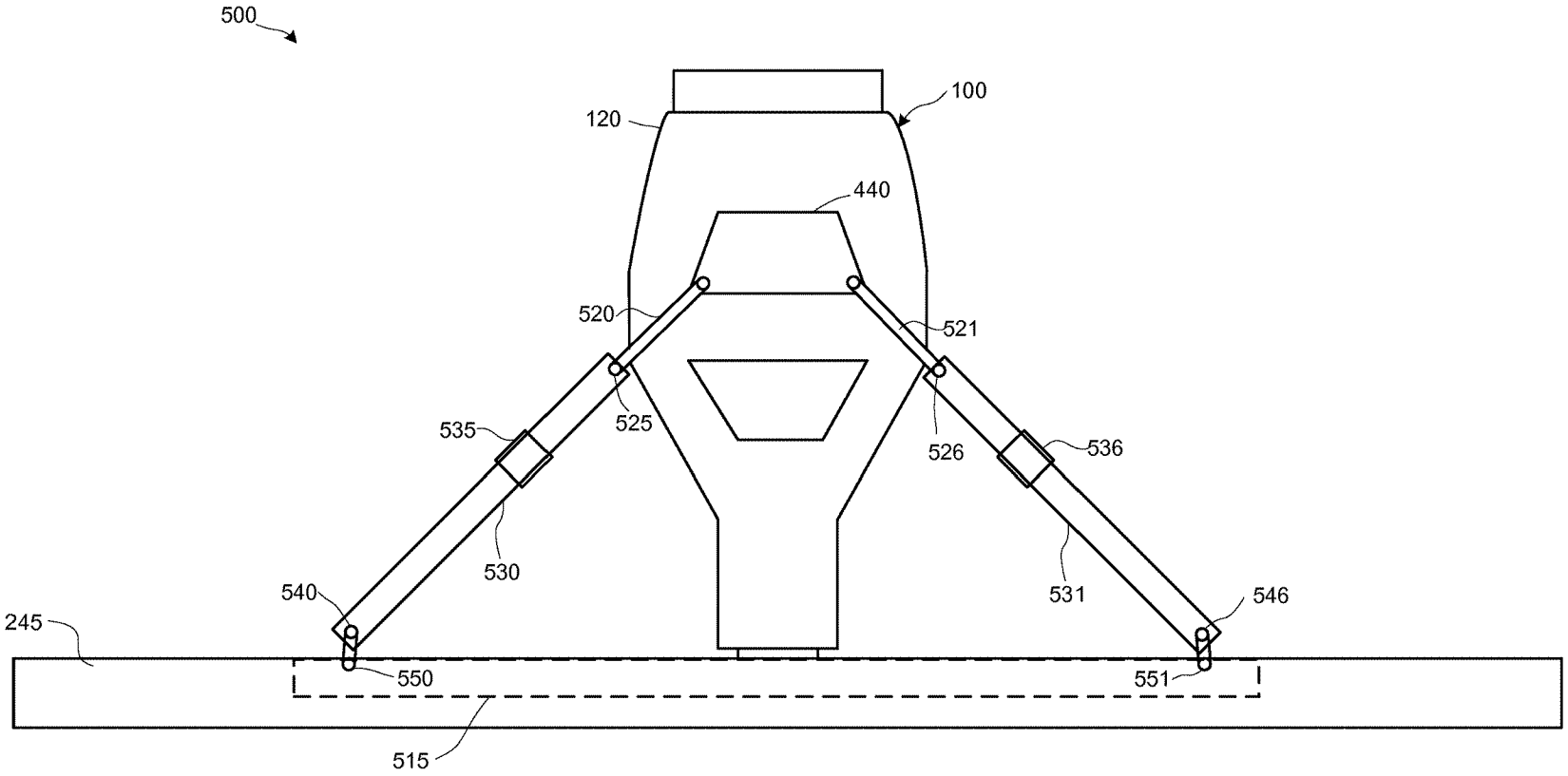
FIGS. 5A and 5B depict another example of a strap mechanism that is configured to attach a mechanical CPR device to a stretcher, in accordance with the present disclosure.
Figure 5B:
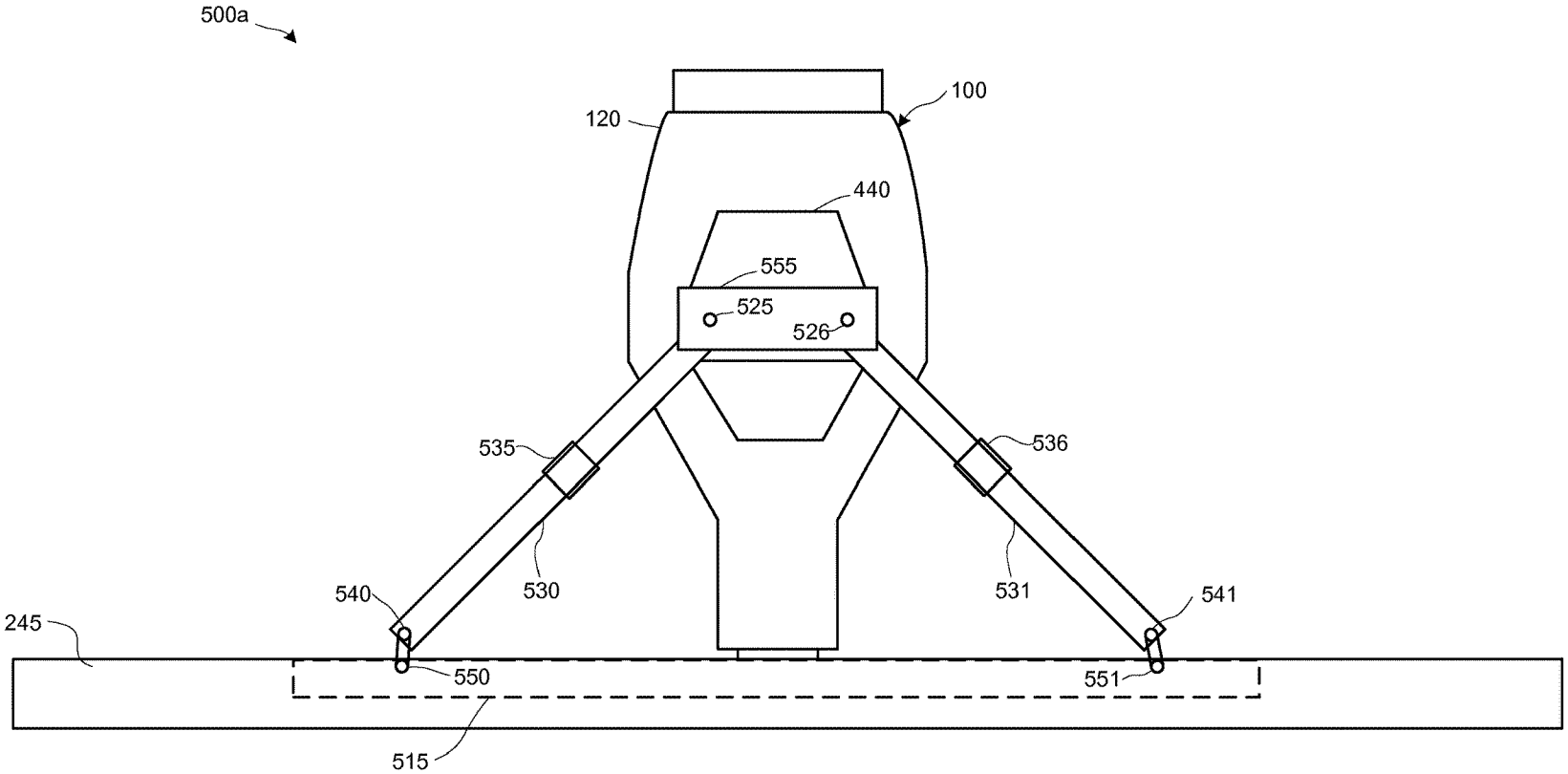

FIGS. 5A and 5B depict two examples of another stabilization strap/system 500. System 500 may include two straps 530, 531 positioned on both sides 120, 125 of a mechanical CPR device 100. Only 1 side 120 is shown for the sake of example; the configuration of straps on the other side 125 of the mechanical CPR device 100 may mirror that for side 120.

As depicted in FIG. 5A, system 500 may include a first removable attachment shackle 520, engagable about the CPR device 100, connected to a first end 525 of a first strap 530. A second removable attachment shackle 521 may be connected to a first end 526 of a second strap 531. The second strap 531 may be disposed about the mechanical CPR device 100 at an angle to the first strap 530, for example anywhere from approximately 20 or 30 degrees to anything less than 180 degrees. A length of at least one of the first and second straps 530, 531 may be adjustable, for example by a buckle or quick release buckle 535, 536. By shortening at least one of straps 530, 531 via buckles 535, 536, the mechanical CPR device 100 may be pulled toward the stretcher 245. As depicted in FIG. 5A, both straps 530, 531 include a buckle 535, 536, which may be a quick release buckle similar to buckle 310. It should be appreciated, however, that only one buckle is needed to secure the mechanical CPR device 100 to the stretcher 245, as will be described below. Shortening at least one of straps 530, 531 may generate tension in one or more of the horizontal direction or the vertical direction, for example dictated by the angle between the first and second straps 530, 531. The generated tension may ensure that the mechanical CPR device 100 stays stationary relative to the stretcher 245. In a similar way, two straps may be arranged in the same manner to secure the other side 125 of the technical CPR device 100 to the stretcher 245. In this way, unwanted movement in directions 250, 255, and/or 260 may be reduced or eliminated, thus provided for more safe and effective operation of the mechanical CPR device 100.

In some aspects, one or more of attachment shackles 520, 521 may be made of a flexible or semi-flexible material. The attachment shackles 520, 521 may be looped through opening 440 of side 120, for example on opposite sides of the opening 440, and attached back to the first ends 525, 526, of the first and second straps 530, 531. In some cases, the flexible attachment shackles 520, 521 may help further secure the mechanical CPR device 100 to the stretcher 245.

Figure 5C:
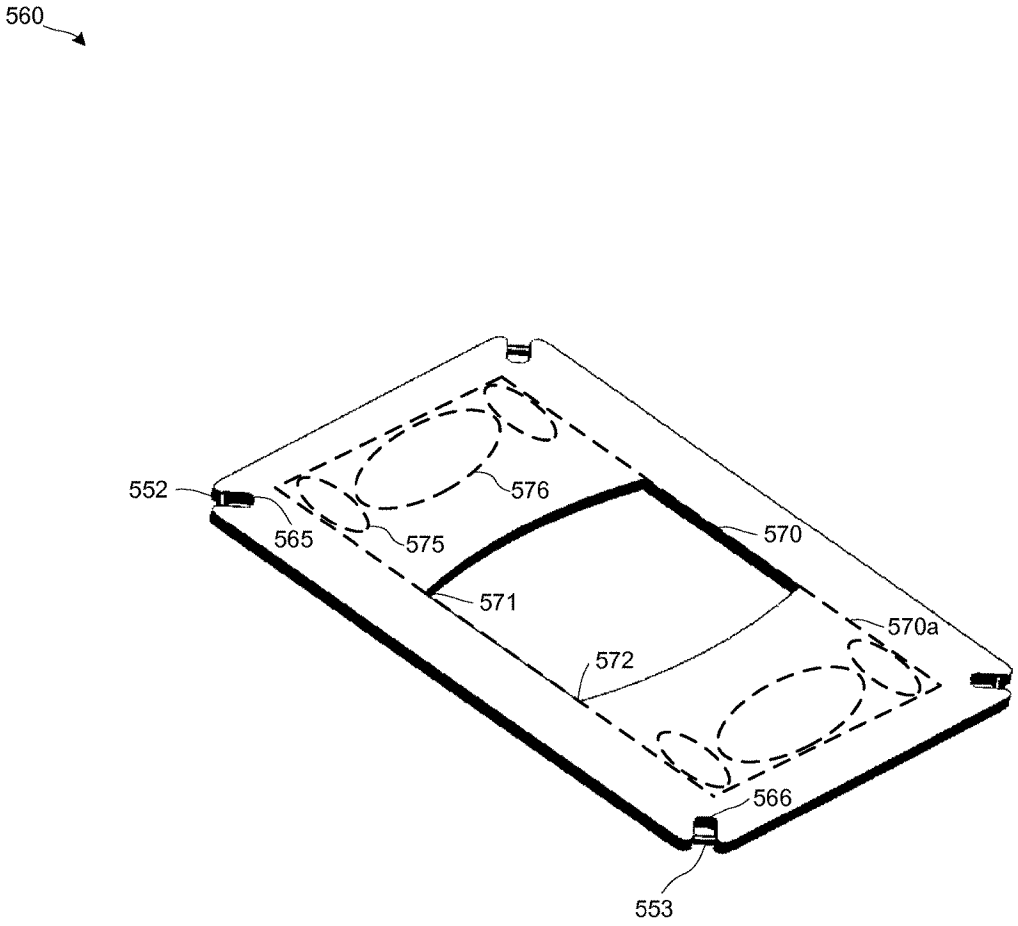
FIG. 5C depicts an example of a plate used for attaching a mechanical CPR device to a stretcher in combination with a strap mechanism, according to an aspect of the present disclosure.

Each of the first and second straps 530, 531 may also include a hook 550, 551 or other attachment means, connected to second ends 540, 541 of straps 530, 531. The hooks 550, 551 may engage the stretcher 245 directly, for example, around a member or bar of the stretcher 245. In other cases, one or more of hooks 550, 551 may include a flexible loop that may be wrapped around any portion of the stretcher and connected back to ends 540, 541 of straps 530, 531. In other cases, the hooks 550, 551 may be configured to engage a stretcher ski 515, which may be used to help move a patient 200, for example onto stretcher 245. In other cases, the hooks 550, 551 may be configured to engage a back plate 560, as depicted in FIG. 5C, for example about bars 552, 553, by fitting partially in recesses 565, 566. The engagement of straps 530, 531 to the stretcher 245, stretcher ski 515, or back plate 560 may be duplicated on the other side 125 of the mechanical CPR device 100.

In other instances, hooks 550, 551 of straps 530, 531 may engage opening 570 of back plate 560. In some cases, the opening 570 may be substantially rectangular, and the hooks 550, 551 may engage corners 571, 572 of opening 570. In some aspects, opening 570 may take any shape and be of any size relative to the back plate 560 (e.g., larger opening 570*a*). In some instances, straps 530, 531 may wrap around a portion of the back plate 560 through opening 570, for example, positioned at or near corners 571, 572, or anywhere along the perimeter of opening 570. In other examples, one or more additional openings may be provided on back plate 560. Straps 530, 531 may engage the back plate 560 either via hooks 550, 551 about the additional openings or via straps 530, 531 wrapping around back plate 560 through the additional openings. In some aspects, back plate 560 may have 4 openings 575, positioned proximal to the outside corners of the back plate 560 in place of (or in some cases, in addition to) opening 570. Openings 575 may be round, substantially round, oval-shaped, rectangular, etc. In other aspects, back plate 560 may have 2 openings 576, each positioned proximal to an end of the back plate 560 (e.g., the short ends of back plate 560). It should be appreciated that any number of openings having any shape may be provided at various locations on back plate 560, such as to provide different attachment points for straps 530, 531. In some aspects, rings or similar loop-structures may be positioned at outside corners of back plate 560, for example, in place of bars 552, 553, to engage straps 530, 531.

In some aspects, one more straps (not shown), such as straps 530, 531 may engage or loop around one or more openings 570 of back plate 560 and extend around the patient 200 to secure the patient 200 to the mechanical CPR device 100. In some aspects, the one or more straps (e.g., adjustable length straps including one or more adjustable buckles) may extend around shoulders of patient 200, and connect to a top portion of mechanical CPR device 100 (e.g., to sides 120, 125). In yet some aspects, the one more straps may additionally or alternatively extend around the waist of patient 200, and connect to a lower portion of mechanical CPR device 100 (e.g., lower portion 105). In this way, the patient 200 may be secured to the mechanical CPR device 100 independent of a stretcher 245 or other patient carrying device. In some examples, the patient 200 secured to the mechanical CPR device 100 may then be secured to the stretcher 245 or other patient carrying device, for example via the techniques described in reference to FIGS. 3A, 3B, 4A, 4B, 5A, 5B, 5D, 6A, and/or 6B.

In some aspects, back plate 560 may be used in combination with strap system 300 described above. In some aspects one or more additional straps (not shown) may be included to secure the patient 200 (e.g., around the shoulders) to the mechanical CPR device 100, for example, removable attached to or about sides 120, 125.

As depicted in FIG. 5B, another example of a strap system 500*a* may include straps 530, 531 engaged and/or removably attached to a medical device bracket 555, which may be disposed near or about the opening 440. In some cases, ends 525, 526 of straps 530, 531 may attach about points of the medical device bracket 555, for example looping around posts or bar-type structures included as part of the medical device bracket 555. In some cases, the bracket 555 may include two pieces that are easily separable, for example, to facilitate removal of the strap system 500*a* from the mechanical CPR device 100. In other cases, the bracket 555 may include releasable metal brackets that engage the straps 530, 531, and which may be released to disengage the mechanical CPR device 100 from the stretcher 245. In some aspects, the bracket 555 may restrict the angle between the first and second straps 530, 530, for example, by limiting rotation or movement of the straps 530, 531 relative to the bracket 555. In other respects, system 500*a* may include aspects of system 500 described above.

Figure 5D:
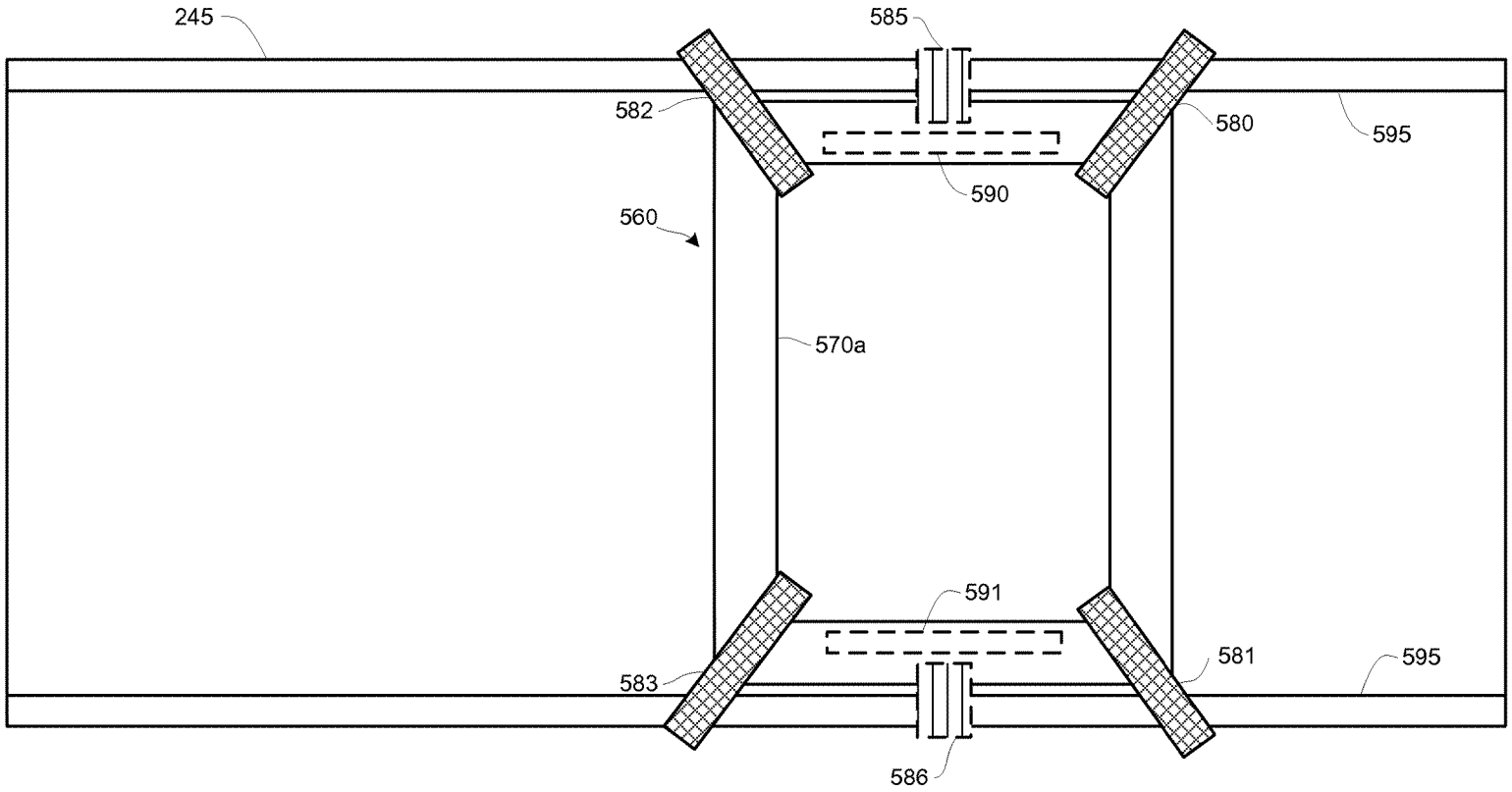
FIG. 5D depicts an example of a plate configured for attaching a mechanical CPR device to a stretcher, attached to the stretcher, according to an aspect of the present disclosure.

As depicted in FIG. 5D, back plate 560, or another similar plate or structure, may be secured directly to stretcher 245 or another type of rigid carrying structure. In some cases, back plate 560 may be attached or secured to stretcher 245 via straps 580-583 looped around opening 570*a* of stretcher 560 and around outside rails 595 of stretcher 245. In some aspects, straps 580-583 may be secured or looped around other portions of the stretchers 245 or other rigid or semi-rigid carrying device, such as a transportation bed or table, cath lab, etc. (not shown). The back plate 560 may further include additional spaces, hooks, other attachment means 590, 591, etc., for attaching to mechanical CPR device 100, such as to lower portion 105 and/or sides 120, 125 of mechanical CPR device 100. Attachment means 590, 591 may be located on either side of the back plate 560, such as proximate to the long sides of stretcher 245. The back plate 560 may be positioned on and attached to the stretcher 245 prior to arriving at an emergency situation, prior to placement of patient 200 onto stretcher 245, and/or prior to performing mechanical CPR on a patient 200. Upon the occurrence of an emergency situation and/or the need for performing mechanical CPR on a patient, a patient 200 may be placed on the stretcher 245 and the mechanical CPR device 100 may be easily and quickly attached to the stretcher 245 in the correct location relative to the stretcher 245 and/or patient to enable safe performance of mechanical CPR. In other cases, a patient 200 may already be attached to a mechanical CPR device 100, for example, as described above. In this scenario, the patient 200 and the mechanical CPR device 100 may be placed and attached to stretcher 245 easily and in the correct location to enable mechanical CPR to be performed on the patient while preparing for and transporting the patient. In some examples this may include placing an unstable patient 200 on helicopter stretcher and performing mechanical CPR during flight of the patient, on a cath lab table during a PCI intervention, etc. In some cases, placement of the patient 200 on the stretcher 245 with the back plate 560 already attached may be performed before any cardiac arrest has occurred or CPR is needed. In yet other examples, back plate 560 or a similar functioning structure may be built into or integrated into a stretcher 245 or other patient carrying device, such as a spine board or patient transportation chair, to provide similar benefits.

In some aspects, any of openings 570, 575, 576, or other spaces, may be used to attach back plate 560 to stretcher 245 via one or more straps 580-583. In some cases, the straps 580-583 may include detachable buckles to enable placement around back plate 560 through openings 570, 575, 576, etc. and around portions of stretcher 245, such as side rails 595, for example, at any desired location on stretcher 245 or other patient carrying device. In some examples, straps 580-583 may include one or more hooks, releasable clasps, buckles, etc., to enable attachment to the back plate 560 and/or stretcher 245. The straps 580-583 may incorporate one or more aspects of straps 305, 320, 321, 530, and/or 531 described above. In other aspects, one or more rigid structures 585, 586, such as plates, clasps, buckles, etc., may additionally or alternatively be used to attach the back plate 560 to stretcher 245 in a position that enables correct performance of mechanical CPR and quick attachment of a mechanical CPR device 100 to the stretcher 245. In other aspects, other attachment means, such as suction cups, quick release buckles, or any other releasable attachment means may be utilized to attach back plate 560 to stretcher 245, for example, attached to various portions or locations of back plate 560. It should be appreciated that back plate 560, as contemplated herein, may be a variety of shapes and sizes, to enable quick attachment of a mechanical CPR device 100 to a stretcher 245 or other rigid or semi rigid carrying structure and as a result, enable safe and correct performance of mechanical CPR on a patient 200.

Figure 6A:
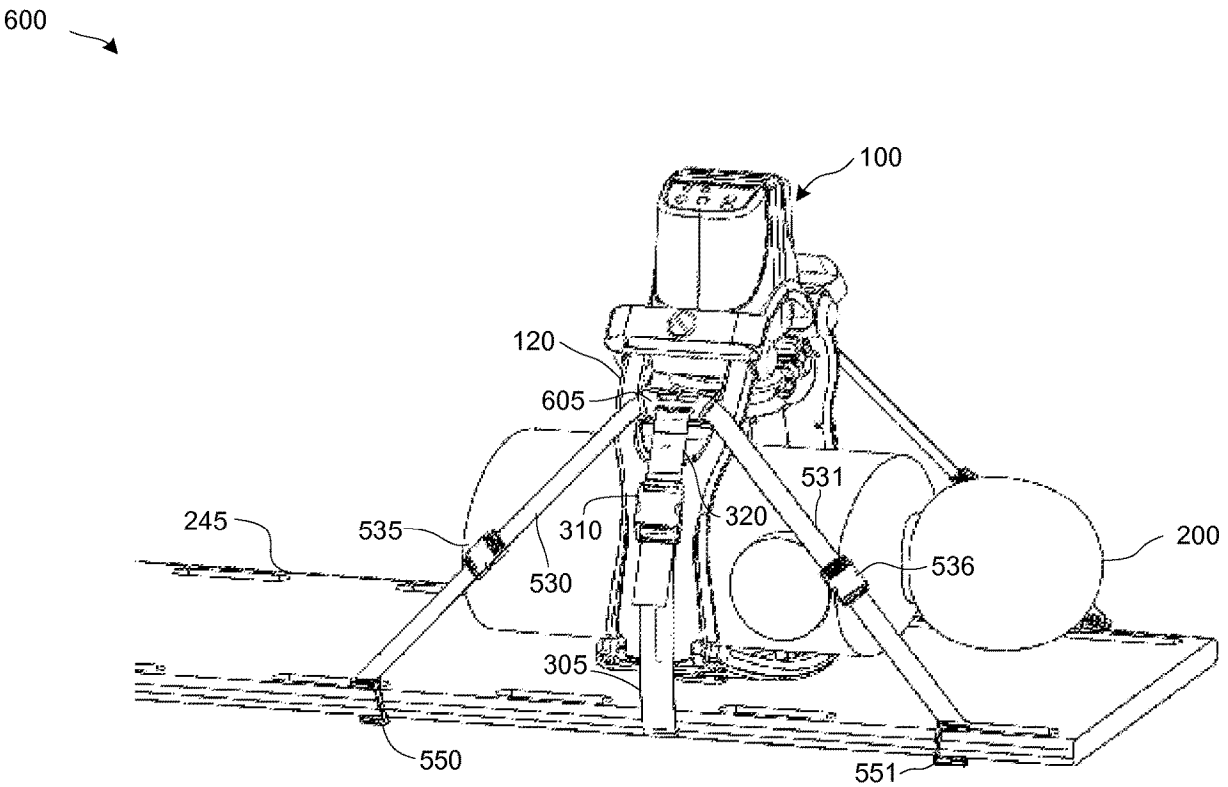
FIGS. 6A and 6B depict other examples of a strap mechanism that is configured to attach a mechanical CPR device to a stretcher, in accordance with the present disclosure.

FIG. 6A depicts another example of a strap system 600. Strap system 600 is a combination of strap 305 described in reference to FIGS. 3A, 3B, 4A, and 4B, and straps 530 and 531 described in reference to FIGS. 5A-5C. Strap system 600 will be primarily described in reference to one side 120 of the mechanical CPR device 100; however, it should be appreciated that another portion of strap system 600, engagable about the other side 125 of the mechanical CPR device 100, may be similarly configured. Strap 305 may be positioned around the bottom of stretcher 245 holding patient 200 and connect to sides 120, 125 of a mechanical CPR device 100. Strap 305 may be connected to adjustable buckles 310, 311, which are in turn connected to straps 320, 321. Straps 320, 321 may be connected, and in some cases rotatably connected, to removable shackles 605, 606 (not shown), which are engagable about sides 120, 125. The shackles 605, 606 may incorporate one or more aspects of shackles 315, 316 described above, including shackle member 420, and/or U-shaped, V-shaped, C-shaped, other similar-shaped bracket portion 425, etc.

Shackles 605, 606 may further include one or more aspects of medical device bracket 555, also described above, including, for example, attachments, such as posts, bar-type structures, and/or releasable metal brackets, that engage ends 525, 526, of straps 530, 531. In some aspects, the bracket 555 may restrict the angle between the first and second straps 530, 531. The straps 530, 531, may include hooks 550, 551 for attachment to the stretcher 245, and may include adjustable buckles 535, 536 that enable adjustment of the length of straps 530, 531, to create tension between the mechanical CPR device 100 and the stretcher 245.

System 600, by utilizing 3 straps between the mechanical CPR device 100 and the stretcher 245 on each side 120, 125 of the mechanical CPR device 100, may provide enhanced or added stability, particularly in minimizing and/or eliminating movement in directions/planes 250, 255, and/or 260.

Figure 6B:
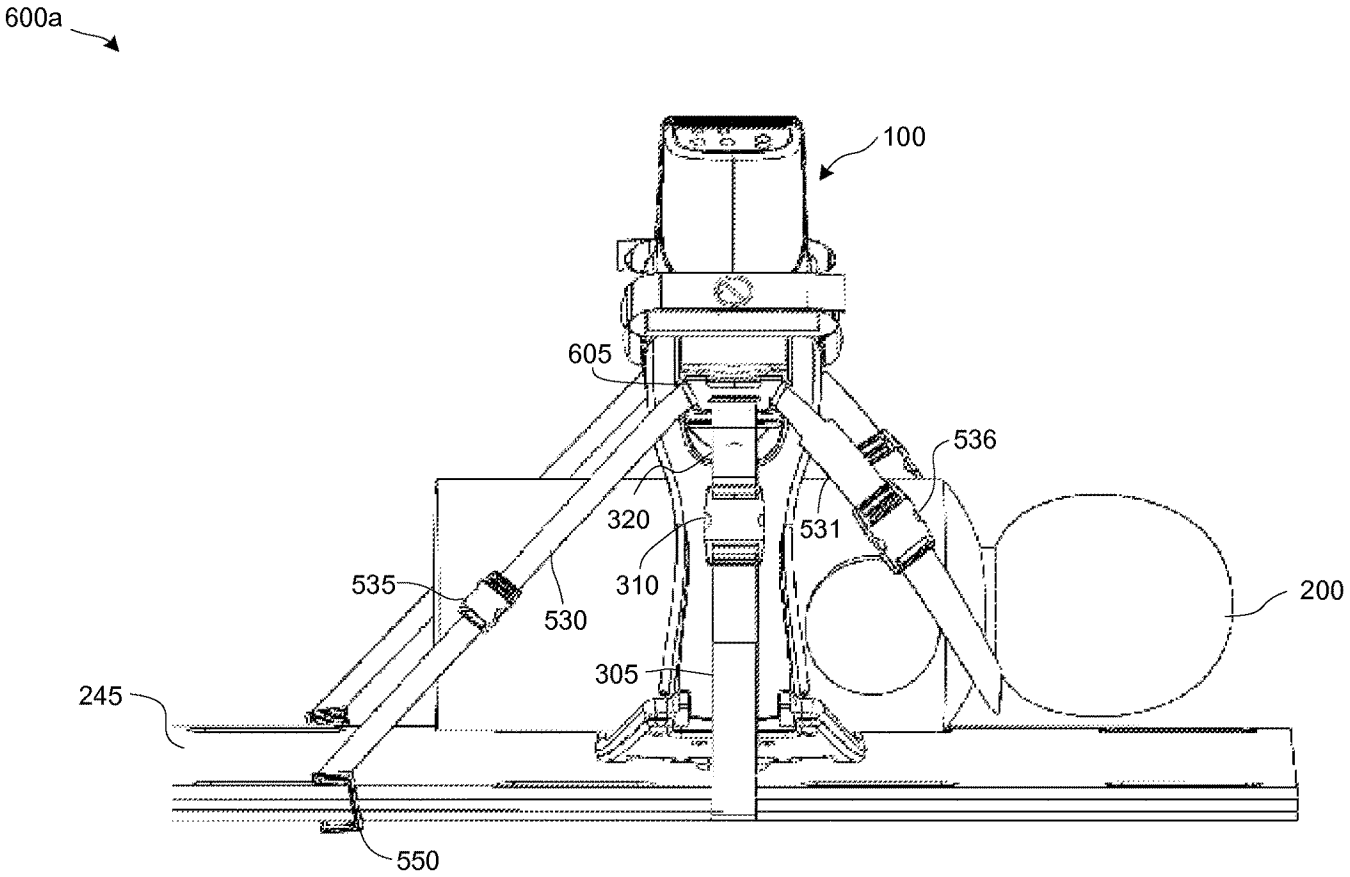

FIG. 6B depicts another example of a strap system 600*a*, including a combination of strap 305 described in reference to FIGS. 3A, 3B, 4A, and 4B, and a modification to straps 530 and 531 described in reference to FIGS. 5A-5C. System 600*a* may be similar to system 600, expect for the configuration of strap 531. As depicted, strap 531, instead of attaching to the same side of stretcher 245, may wrap under patient 200 and connect to shackle 606 (not shown) on the other side 125 of the mechanical CPR device 100. Strap 531 may provide stability between the patient 200, the mechanical CPR device 100, and/or the stretcher 245, by anchoring the patient 200 to the CPR device 100. In some instances, the strap 531 may be secured around the neck or shoulder area of patient 200. In other instances, the strap 531 may be secured around the torso and/or arms of patient 200. In some cases, strap 531 may be of sufficient width to safely engage the patient 200 without restricting blood flow, for example, around the neck of patient 200. In other cases, the strap 531 may be of a smaller width (e.g., the same width as strap 530), with a pad or other malleable structure provided between the strap 531 and the patient 200. In some cases, strap 531 may engage one or more openings 570, 575, 576 of back plate 560 to secure the patient 200 to the mechanical CPR device 100 and/or the stretcher 245.

Figure 7:
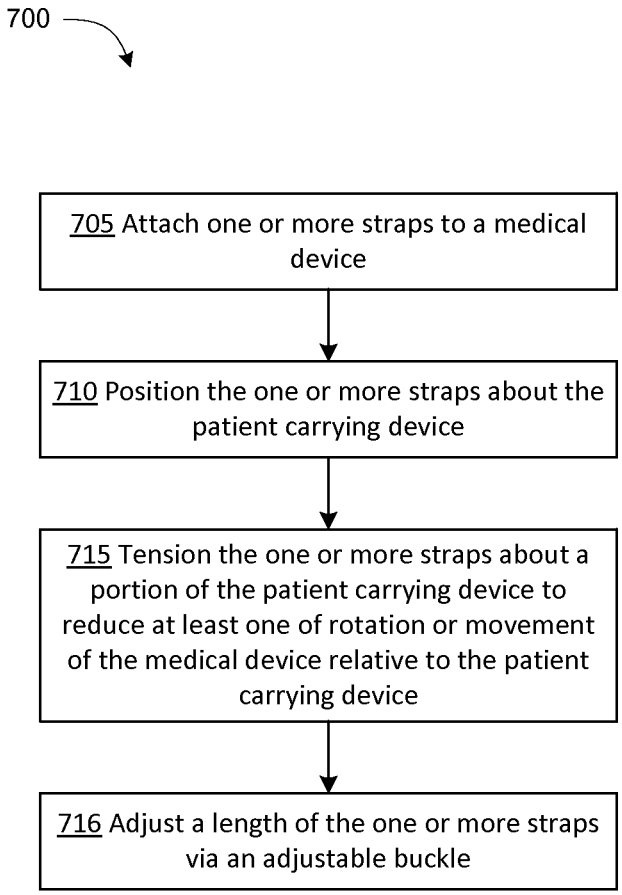
FIG. 7 depicts an example method of securely attaching a medical device to a stretcher, in accordance with the present disclosure.

FIG. 7 depicts an example of a method 700 of securing a medical device, such as a mechanical CPR device 100, to a patient carrying device, such as a stretcher 245, stretcher skis 515, or a back plate 560. In one example, one or more straps may be attached to a medical device at operation 705. In some cases, this many include attaching the strap system 300, 500, or 600 to a mechanical CPR device 100. The one or more straps may then be positioned about a patient-carrying device, such as stretcher 245, at operation 710. In some cases, the one or more straps may be wrapped underneath the stretcher 245, as depicted and described in reference to FIGS. 3A and 3B, placed on both sides of the stretcher, as depicted and described in reference to FIGS. 5A and 5B, or a combination thereof as depicted and described in reference to FIGS. 6A and 6B. The one or more straps may then be tensioned about a portion of the patient carrying device, for example, to reduce at least one of rotation or movement (e.g., in directions 250, 255, or 260) of the medical device relative to the patient carrying device, at operation 715. In some cases, tensioning the one or more straps may include adjusting a length of the one or more straps via one or more adjustable buckles (e.g., buckles 310, 311 and/or buckles 535, 536), at operation 716.

In another aspect, a method for securing a medical device, such as a mechanical CPR device 100, to a patient 200 may include attaching one or more straps to a back plate, such as back plate 560. In some aspects, attaching the one or more straps may include looping the one or more straps through and around one or more openings (e.g., opening 570, 575, 576) on the back plate, or engaging hooks of the straps about bars, or other similar structures of the back plate. The one or more straps may then be positioned around a patient, for example, around the shoulders and/or waist of the patient. The other end of the one or more straps may then be secured to the medical device, for example to sides 120, 125 of mechanical CPR device 100. The one or more straps may then be tensioned about the patient to secure the patient to the medical device, for example via tightening one or more adjustable buckles disposed on the one or more straps.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

In general, the various features and processes described above may be used independently of one another, or may be combined in different ways. For example, this disclosure includes other combinations and sub-combinations equivalent to: extracting an individual feature from one embodiment and inserting such feature into another embodiment; removing one or more features from an embodiment; or both removing a feature from an embodiment and adding a feature extracted from another embodiment, while providing the advantages of the features incorporated in such combinations and sub-combinations irrespective of other features in relation to which it is described. All possible combinations and sub combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example examples. The example systems and components described herein may be configured differently than described. For example, elements may be added to, removed from, or rearranged compared to the disclosed example examples.

While certain example or illustrative examples have been described, these examples have been presented by way of example only, and are not intended to limit the scope of the inventions disclosed herein. Indeed, the novel methods and systems described herein may be embodied in a variety of other forms. The accompanying claims and their equivalents are intended to cover such forms or modifications as would fall within the scope and spirit of certain of the inventions disclosed herein.

What is claimed is:

1. A stabilization system for stabilizing a mechanical CPR device as the device is mounted on a patient and the patient is being moved on a stretcher, comprising:

a first removable attachment shackle connected to a first end of a first strap, wherein the first removable attachment shackle is engagable about the mechanical CPR device;

a second removable attachment shackle connected to a first end of a second strap, the second strap disposed about the mechanical CPR device at an angle to the first strap, wherein a length of at least one of the first and second straps is adjustable to generate tension between the first and second straps;

a third removable attachment shackle connected to a first end of a third strap, wherein the third removable attachment shackle is engagable about the mechanical CPR device;

a fourth removable attachment shackle connected to a first end of a fourth strap, the fourth strap disposed about the mechanical CPR device at a second angle to the third strap, wherein a length of at least one of the third and fourth straps is adjustable to generate tension between the third and fourth straps;

a fifth strap having a first end connected to a first bracket of the mechanical CPR device;

a sixth strap, wherein the sixth strap is configured to be looped underneath the stretcher, and wherein a distal end of the sixth strap is connected to a second bracket of the mechanical CPR device; and an adjustable quick release buckle attached between a second end of the fifth strap and a proximal end of the sixth strap, wherein the adjustable quick release buckle includes a female portion and a male portion configured to fit into the female portion and be removable from the female portion by compressing a part of the male portion;

wherein each of the first, second, third, and fourth straps comprise a second end attached to a hook;

wherein the hook connected to the second end of each of the first, second, third, and fourth straps is attachable to a back plate; and wherein the back plate comprises recesses and bars for engagement with the hooks.

2. The stabilization system of claim 1, wherein at least one of the first, second, third, or fourth strap comprises an adjustable buckle capable of generating tension.

3. The stabilization system of claim 1, wherein each hook comprises a detachable loop comprising a flexible material.

4. The stabilization system of claim 1, wherein the hook connected to the second end of each of the first, second, third, and fourth straps is attachable to at least one of a stretcher, or one or more skis.

5. The stabilization system of claim 1, where at least one of the first, second, third, or fourth removable attachment shackles comprise a flexible material.

6. The stabilization system of claim 1, where at least one of the first and second, or the third and fourth, removable attachment shackles is engagable about a medical device bracket.

7. The stabilization system of claim 6, wherein the medical device bracket restricts the angle between the first and second strap or the second angle between the third and fourth strap.

* * * * *